US005544940A

United States Patent [19]

Stevens

[11] Patent Number: 5,544,940

[45] Date of Patent: Aug. 13, 1996

[54] PIVOTAL REAR LATCH ASSEMBLY FOR AN ARMREST APPARATUS FOR A WHEELCHAIR

[75] Inventor: Rex W. Stevens, Fresno, Calif.

[73] Assignee: Quickie Designs Inc., Fresno, Calif.

[21] Appl. No.: 353,636

[22] Filed: Dec. 12, 1994

[51] Int. Cl.[6] ..... A47C 7/54

[52] U.S. Cl. ..... 297/411.28; 297/DIG. 4

[58] Field of Search ..... 297/115–117, 411.2, 297/411.23, 411.25, 411.26, 411.27, 411.28, 411.3, 411.31, 411.44, DIG. 4

[56] References Cited

U.S. PATENT DOCUMENTS

| | | |
|---|---|---|
| 1,420,924 | 6/1922 | Hogan . |
| 2,713,891 | 7/1955 | Linquist . |
| 3,140,119 | 7/1964 | Offner . |
| 3,174,800 | 3/1965 | Jennings . |
| 3,376,065 | 4/1968 | Kernes . |
| 3,883,175 | 5/1975 | Rodaway . |
| 4,358,125 | 11/1982 | Charles . |
| 4,606,579 | 8/1986 | Douglass . |
| 4,840,390 | 6/1989 | Lockard et al. . |
| 5,242,138 | 9/1993 | Kornberg . |

FOREIGN PATENT DOCUMENTS

| | | |
|---|---|---|
| 2058683 | 4/1981 | United Kingdom . |

*Primary Examiner*—Milton Nelson, Jr.
*Attorney, Agent, or Firm*—Flehr Hohbach Test Albritton & Herbert

[57] ABSTRACT

An two-post armrest apparatus (10) including an armrest frame (12) having a horizontal frame member (13) and downwardly depending front post (15) and rear post (16). A latch assembly (17) includes a latch member (20) which releasably couples the armrest frame (12) to the wheelchair frame (11), and a pivot assembly (21) which cooperates with the latch member (20) for operation thereof. Upon release of the front latching or locking assembly (22) and swinging the armrest frame (12) away from the wheelchair frame (11) and about pivot assembly (21), the latch member (20) is automatically disengaged enabling removal of the armrest frame (12).

16 Claims, 4 Drawing Sheets

PIVOTAL REAR LATCH ASSEMBLY FOR AN ARMREST APPARATUS FOR A WHEELCHAIR

TECHNICAL FIELD

The present invention relates, generally, to armrest apparatus for wheelchairs and, more particularly, to armrest apparatus with latching devices releasably latching the armrest to a wheelchair frame.

BACKGROUND ART

Wheelchairs generally include a seat assembly mounted to a wheelchair frame and two armrests positioned adjacent to and on opposing sides of the seat. These armrests generally provide the occupant support during ingress and egress from the wheelchair, as well as providing comfort and convenience for the occupant by furnishing a fixture upon which they may rest their arms and shift their weight while seated in the wheelchair.

Typically, an armrest includes a generally horizontal frame with an armrest pad supported thereatop, and a pair of spaced-apart armrest posts (i.e., front and rear) extend downwardly from opposite ends of the horizontal frame. Each post is oriented in a substantially vertical manner for ease of mounting, and height adjustment, relative to wheelchair main frame. The wheelchair main frame usually includes a pair of spaced-apart upwardly extending receiving tubes each providing a post receiving bore dimensioned to slidably and telescopically receive the distal ends of the corresponding armrest post portions. Generally, these two-post designs provide more lateral support and stability than a single-post armrest assembly, which are also used in the industry.

While two-post armrests provide adequate mounting stability and support, several problems are inherent. For example, due to RESNA regulations, both the front and rear posts must be securely locked to the wheelchair frame. Such securement is generally accomplished by providing separate manually operable latch mechanisms to releasably latch the respective posts to the wheelchair frame. For those severely impaired persons or those of limited dexterity, manual actuation of the rear latch assembly is often difficult or physically impossible from the seated position.

The front latching mechanism for the front post is generally accessible for operation thereof by the wheelchair occupant. The rear latching mechanism, however, is typically situated behind the seating system rearward of the occupant's shoulders. Moreover, the rear latch mechanism is often obstructed by the wheelchair rear wheel. Accordingly, this arrangement severely increases the difficulty of unlatching the rear latching device and/or removing the armrest from the seated position.

Further, physically impaired persons may encounter difficulty aligning the two posts with the receiving bores when attempting to install the armrest to the wheelchair frame. Often, the posts are slightly skewed which offsets the alignment with the bores.

Moreover, when attempting to adjust the height or remove the armrest from the main frame receiving bores, those with limited physical capabilities may be unable to telescopically extend or retract both of the front and rear posts simultaneously into or out of the corresponding post receiving bores in a smooth, even, unskewed manner. Skewing during adjustment causes the posts to lodge or jam in the corresponding receiving bores, and prevent removal.

DISCLOSURE OF INVENTION

Accordingly, it is an object of the present invention to provide a two-post armrest apparatus for a wheelchair which is more accessible to the occupant for easier actuation by physically-impaired users.

It is another object of the present invention to provide a two-post armrest apparatus which facilitates installation and removal of the armrest assembly from the seated position.

Still another object of the present invention is to provide a two-post armrest apparatus for a wheelchair which provides stability and support for the occupant.

It is a further object of the present invention to provide a two-post armrest apparatus which is durable, compact, easy to maintain, has a minimum number of components, is easy to use by unskilled personnel, and is economical to manufacture.

The present invention includes an armrest apparatus for a wheelchair having a wheelchair main frame. The armrest apparatus, briefly, comprises an armrest frame having a front post and downwardly depending rear post, and a latch assembly operably mounting the armrest frame to the wheelchair frame. A latch member of the latch assembly is movable between an engaged position and a disengaged position. In the engaged position, the latch member couples the rear post to the wheelchair frame proximate a rear portion thereof. In the disengaged position, the latch member is moved out of contact with the rear post to enable removal of the armrest frame from the wheelchair frame. Further, the latch assembly includes a pivot assembly pivotally mounting the armrest frame to the wheelchair frame for pivotal movement between a closed position and an opened position. In the closed position, the pivot assembly enables the latch member to move toward the engaged position, while in the opened position, the front post is pivoted away from the wheelchair frame, while the latch member is moved to the disengaged position.

The present invention enables the wheelchair occupant to disengage the rear latching mechanism of the armrest apparatus by swinging the armrest frame away from the wheelchair frame and about the pivot assembly, which automatically disengages the latch member. Hence, the armrest frame can then be easily removed from the rear latching mechanism without requiring the wheelchair occupant to directly manually manipulate the rear latch mechanism.

BRIEF DESCRIPTION OF THE DRAWING

The assembly of the present invention has other objects and features of advantage which will be more readily apparent from the following description of the Best Mode of Carrying Out the Invention and the appended claims, when taken in conjunction with the accompanying drawings, in which:

BEST MODE OF CARRYING OUT THE INVENTION

Figure 1A:
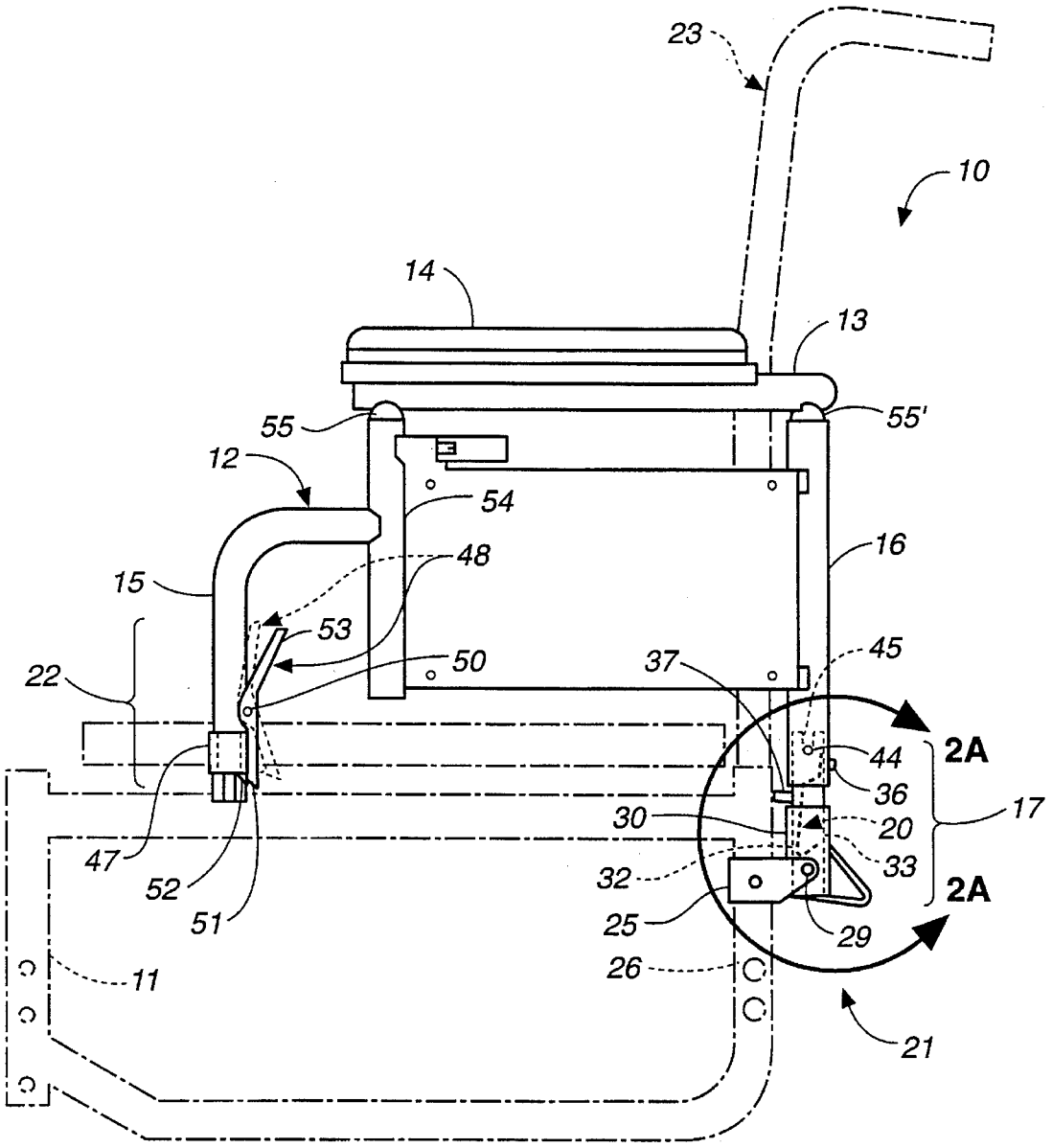
FIGS. 1A–1C are a series of side elevation views of the removable armrest apparatus constructed in accordance with the present invention and in the process of being removed from mounting to a wheelchair frame assembly.
Figure 1B:
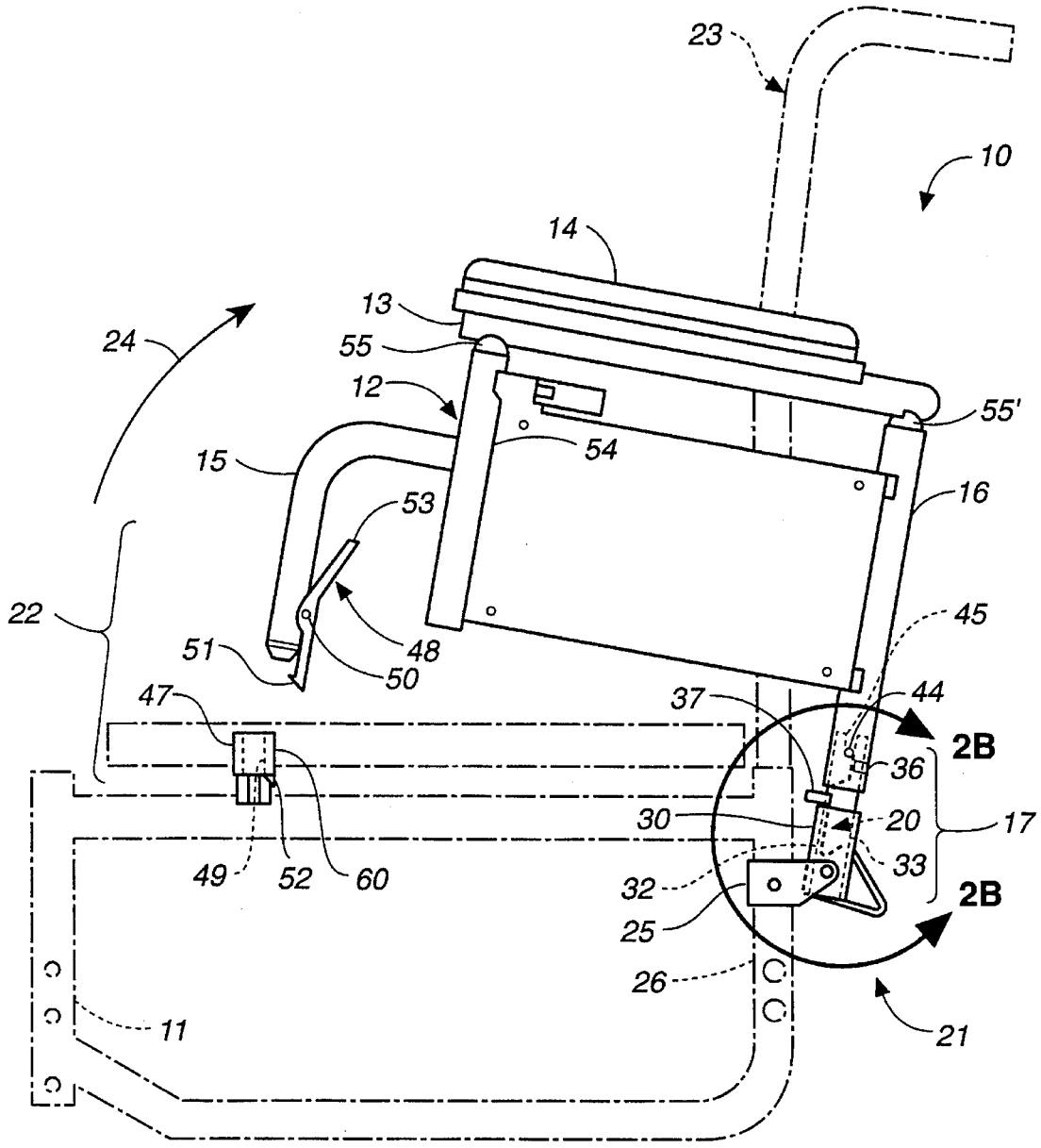
Figure 1C:
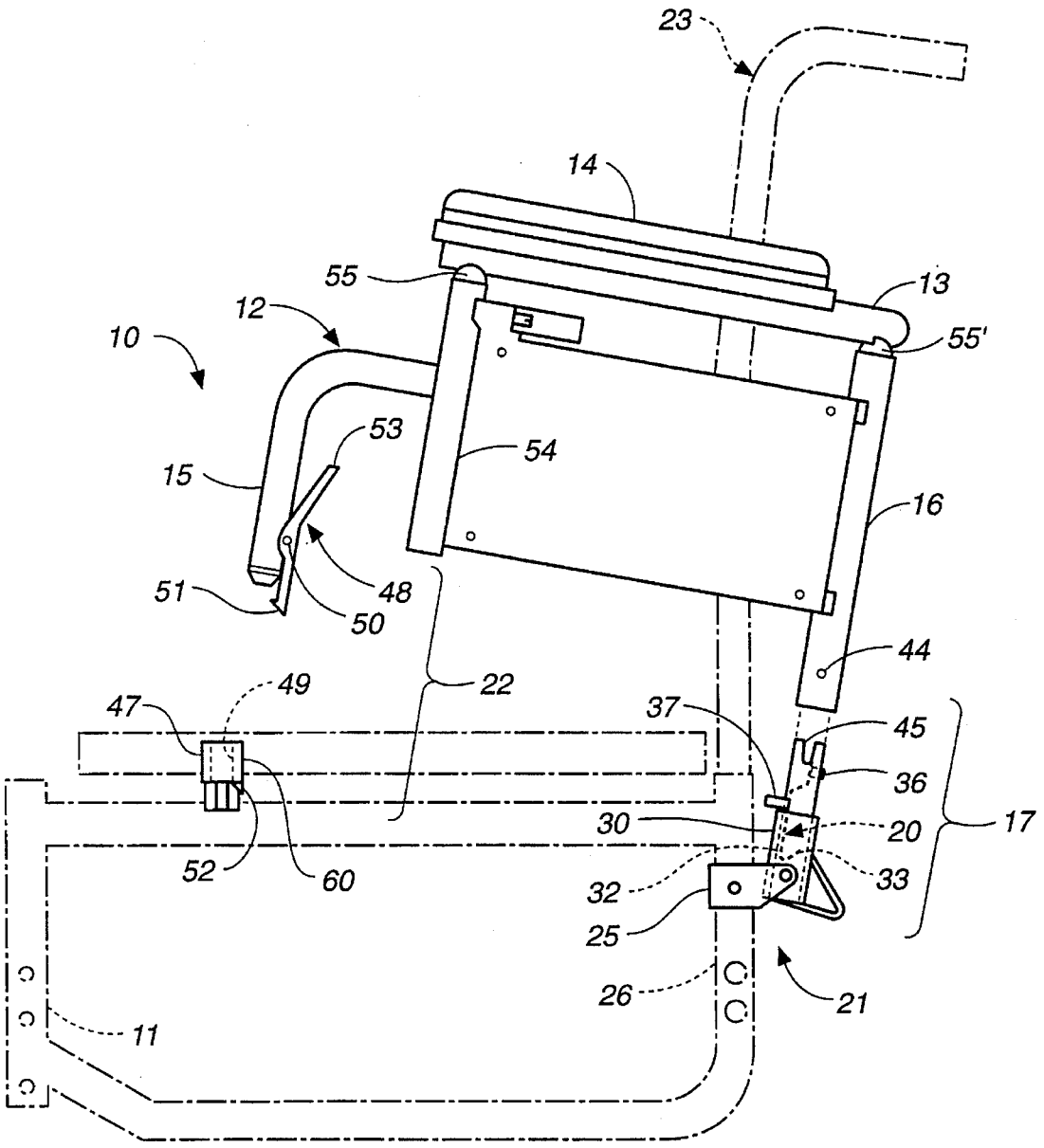

The following description is presented to enable a person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded with the widest scope consistent with the principles and features disclosed herein. It will be noted here that for a better understanding, like components are designated by like reference numerals throughout the various figures. Attention is now directed to FIGS. 1A–1C, where the subject armrest apparatus, generally designated 10, is illustrated mounted to a wheelchair frame 11 of a wheelchair assembly. Armrest apparatus 10, briefly, includes an armrest frame 12 having a horizontal frame member 13 supporting a pad 14 thereatop, and downwardly depending front post 15 and rear post 16. A latch assembly, generally designated 17, operably mounts armrest frame 12 to wheelchair frame 11, and includes a latch member 20 movable between an engaged position and a disengaged position. In the engaged position (FIGS. 1A and 2A), latch member 20 couples rear post 16 to wheelchair frame 11 proximate a rear portion thereof. In the disengaged position (FIGS. 1B, 1C and 2B), the latch member is moved out of contact with rear post 16 to enable removal of armrest apparatus 10 from wheelchair frame 11 (FIG. 1C). Further, latch assembly 17 includes a pivot assembly, generally designated 21, pivotally mounting armrest frame 12 to wheelchair frame 11 for pivotal movement between a closed position and an opened position. In the closed position (FIGS. 1A and 2A), pivot assembly 21 enables latch member 20 to move toward the engaged position, while in the opened position (FIGS. 1B, 1C and 2B), front post 15 is pivoted away from wheelchair frame 11, while latch member 20 is moved to the disengaged position.

In the preferred embodiment, a front latching or locking mechanism, generally designated 22, operably couples or latches front post 15 to the wheelchair frame proximate a front portion thereof. Locking mechanism 22 is manually movable between a locked position and an unlocked position. In the locked position (solid lines in FIG. 1A), locking mechanism 22 releasably locks or latches front post 15 to wheelchair frame 11 when pivot assembly 21 is in the closed position. In the unlocked position (FIGS. 1B and 1C, and phantom lines in FIG. 1A), the locking mechanism releases front post 15 from wheelchair frame 11 for removal or disengagement therebetween.

In accordance with the present invention, the inaccessible rear latch assembly 17 enables automatic disengagement of latching member 20 through pivotal manipulation of the armrest frame towards the opened position. Hence, the wheelchair occupant is not required to reach rearward behind the seat or backrest assembly 23 to actuate the rear latching mechanism, as is required in the prior art applications. By unlocking front locking mechanism 22 and pivotally swinging armrest frame 12 rearwardly about pivot assembly 21 (in the direction of arrow 24 in FIG. 1B), latching assembly 17 moves from the closed position (FIGS. 1A, 2A) to the opened position (FIGS. 1B, 2B), which automatically moves latch member 20 from the engaged position (FIGS. 1A, 2A) away from the wheelchair frame to the disengaged position (FIGS. 1B, 2B) so that the armrest frame 12 can be removed therefrom (FIG. 1C).

Figure 2A:
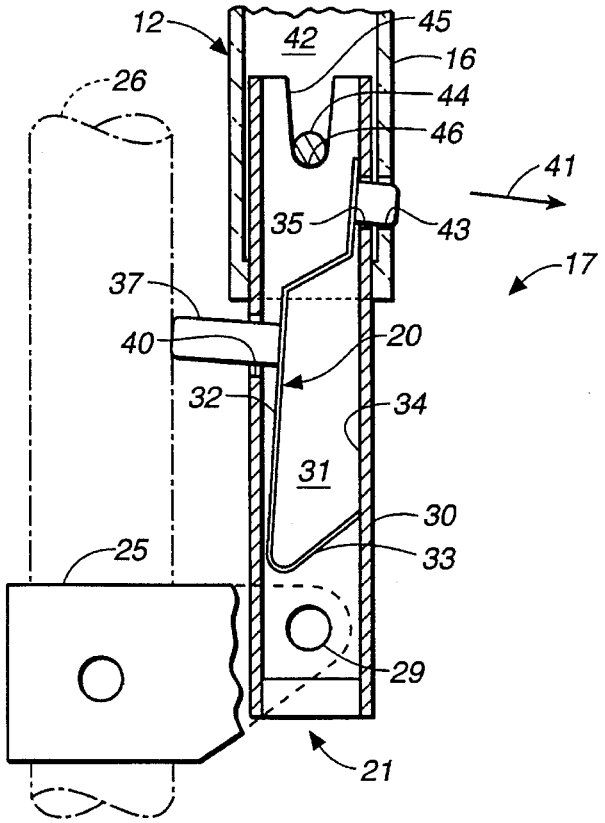
FIGS. 2A and 2B are enlarged, fragmentary, side elevation views, in partial cross-section, of the armrest apparatus taken substantially along the lines 2A—2A, 2B—2B in the corresponding FIGS. 1A, 1B, respectively.
Figure 2B:
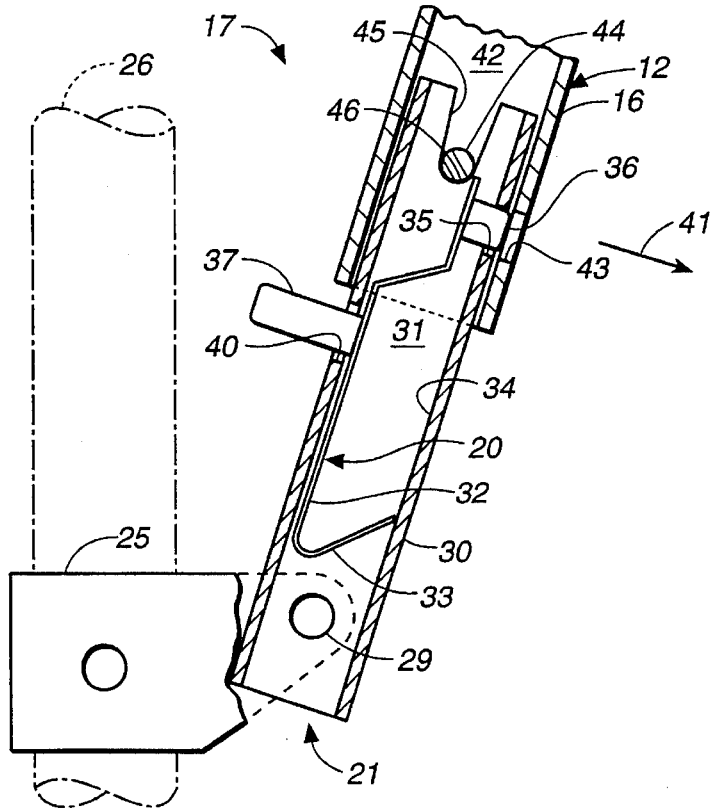

FIGS. 2A and 2B best illustrate that pivot assembly 21 includes a mounting bracket 25 fixedly mounted to a vertical support 26 of wheelchair frame 11. A tube member 30 of pivot assembly 21 is pivotally mounted to mounting bracket 25 through bolt 29 for pivotal movement of the tube member about a horizontal axis between the closed position and the opened position.

Hollow tube member 30 provides a cavity 31 which houses latch member 20 therein for movement between the engaged position and the disengaged position. Latch member 20 includes a hook-shaped leaf spring 32 having a lower hook portion 33 formed to operably engage the vertical walls 34 of the tube member which form cavity 31. Further, the member includes a retaining pin 36 mounted to the upper distal end thereof. Tube member 30 includes a pin receiving aperture 35 formed for sliding receipt of retaining pin 36 therethrough when latch member 20 is in the engaged position. Proximate a central portion of leaf spring 32 is an elongated button member 37 extending outwardly therefrom toward the wheelchair frame vertical support 26 and in an opposite direction of retaining pin 36. Tube member 30 includes a button receiving aperture 40 extending therethrough for sliding receipt of the button member during movement of the latch member between the engaged and disengaged position.

Briefly, when the distal end of button member 37 engages or abuts vertical support 26, during pivotal movement of the latch assembly from-the opened position (FIG. 2B) to the closed position (FIG. 2A), retaining pin 36 is urged into pin receiving aperture 35 (in the direction of arrow 41 in FIG. 2A) by leaf spring 32. As shown in FIG. 2A, hook portion 33 of spring 32 is compressed, in the engaged position, which biases retaining pin 36 toward the disengaged position. Accordingly, upon pivotal movement of the latch assembly from the closed position back to the opened position, button member disengages from contact with vertical support 26 (FIG. 2B) whereby leaf spring 32 urges retaining pin 36 back out of receiving aperture 35 toward the disengaged position.

In the preferred embodiment, rear post 16 provides a longitudinally extending bore 42 formed and dimensioned for sliding telescopic receipt of the distal end of tube member 30 therein. Rear post 16 includes a pin opening 43 formed for receipt of the retaining pin therethrough when the assembly is moved to the engaged position, and during alignment of pin opening 43 with pin receiving aperture 35. Hence, the receipt of retaining pin 36 through pin receiving aperture 35 and pin opening 43 therethrough (FIG. 2A) cooperate to retain rear post 16 removably coupled to latch assembly 17. Upon movement of retaining pin 36 out of pin opening 43 to the unengaged position (FIG. 2B), rear post 16, and hence armrest frame 12, can be separated from tube member 30 (FIG. 1C).

Extending laterally across rear post bore 42 is an alignment bar 44 formed for insertion into a mating alignment slot 45 at the distal end of tube member 30. The alignment slot 45 and corresponding alignment bar 44 cooperated to align rear post pin opening 43 with pin receiving aperture 35 so that retaining pin 36 can extend therethrough. As tube member is inserted into bore 42, alignment bar 44 is slidably received in alignment slot 45 until the alignment bar seats against a bottom groove 46 of slot 45 to align pin opening 43 with receiving aperture 35.

It will be appreciated that the tube member of the pivot assembly could include a bore formed and dimensioned for telescopic sliding receipt of the distal end of the rear post without departing from the true spirit and nature of the present invention.

Referring back to FIGS. 1A–1C, front locking or latching mechanism 22 preferably includes a base member 47 mounted to a front portion of wheelchair frame 11, and a movable locking member 48 pivotally mounted to the armrest frame front post 15. Base member 47 includes a socket 49 at a top portion thereof formed and dimensioned for sliding receipt of the distal end of front post 15 therein. Locking member 48 of the locking mechanism 22 is pivotally mounted to front post 15 through bolt 50 for pivotal movement about a horizontal axis between the locked position (solid lines in FIG. 1A) and the unlocked position (phantom lines in FIG. 1A). A torsion spring member or the like (not shown) biases locking member 48 toward the locked position.

Accordingly, when the armrest frame is positioned in the closed position, the lower distal end of front post 15 is inserted into the socket of base member 47. To removably lock front post 15 to base member 47, locking member 48 preferably includes a tab portion 51 at a lower end thereof which interengages upper curved surface 60 to displace the locking member outwardly against the torsion spring and a lower downwardly facing latching or locking surface 52 on a bottomside of base member 47 for locking engagement therebetween. Upon receipt of the front post 15 in socket 49 of base member 47, the torsion spring urges tab portion 51 inwardly into interengagement with latch surface 52 for releasable retention of front post 15 to base member 47.

Locking member 48 further includes a lever end 53 for manual manipulation of locking member 48 between the locked position and the unlocked position. When pivot assembly 21 is in the closed position, latch member 20 is urged to the engaged position as the distal end of button member 37 abuts against vertical support 26. In turn, leaf spring 32 urges retaining pin 36 rearwardly in the direction of arrow 41 and into rear post pin opening 43 for retainment of the rear post. Similarly, in the closed position, front post 15 is received in socket 49 of base member 47 where locking member 48 is biased to the locked position.

Briefly, the horizontal frame member 13 of armrest frame 12 is preferably vertically movably relative the rear post and the front post for height adjusting purposes of the support pad 14. As shown in FIGS. 1A–1C, armrest frame 12 further includes a support post 54 fixedly mounted to front post 15. Two spaced-apart height adjusting posts 55, 55' extend downwardly from horizontal frame member 13 for sliding telescopic receipt in passages (not shown) provided at the upper distal ends of support post 54 and of rear post 16. Hence, the horizontal frame member and the support pad can be selectively vertically positioned relative the front and rear posts.

At the outset of operation of the present invention, as best viewed in FIGS. 1A and 2A, when pivot assembly 21 is oriented in closed position, latch member 20 is situated in the engaged position, and front locking mechanism 22 is situated in the locked position for retention of the front and rear posts to the wheelchair frame. To remove armrest apparatus 10, the wheelchair occupant manually manipulates lever member 53 to pivot tab portion 51 from the engaged position to the disengaged position to. Hence, the tab portion moves free of interengagement with latch surface 52 which enables removal of front post 15 from base member 47. Subsequently, the wheelchair occupant can then lift the front post out of socket 49 of the base member and pivotally move armrest frame 12 about pivot assembly bolt 50 and away from the wheelchair frame toward the opened position (in the direction of arrow 24 in FIG. 1B).

In accordance with the operation of the present invention, as pivot assembly 21 moves from the closed position to the opened position, button member 37 disengages from contact with vertical support 26. In turn, as shown in FIG. 2B, the lower hook portion 33 of leaf spring 32 urges retaining pin 36 out of the pin opening 43 of the rear post from the engaged position to the unengaged position. Hence, rear post 16 can then be telescopically separated from tube member 30 (FIG. 1C) for removal of the armrest frame 12.

To install the armrest frame, the reverse procedure is followed. Briefly, tube member 30 is inserted into bore 42 of rear post 16 until alignment bar 44 seats against groove 46 of alignment slot 45 which aligns pin opening 43 with receiving aperture 35. As armrest frame 12 is manually pivoted about pivot assembly from the opened position to the closed position, button member contacts vertical support 26 which in turn urges retaining pin 36 through pin opening 43 of rear post 16 toward the engaged position for retainment thereof. Further pivotal movement of the armrest frame about pivot assembly causes front post 15 to insert into the socket 49 of base member 47 until tab portion 51 of latch member 20 engages surface 60 and thereafter springs back beneath latch surface 52 for locking therebetween.

What is claimed is:

1. An armrest apparatus for use with a wheelchair having a wheelchair frame, said armrest apparatus comprising:

an armrest frame having a front post and downwardly depending rear post; and a latch assembly operably mounting said armrest frame to a wheelchair frame, including a latch member movable between an engaged position, coupling said rear post to the wheelchair frame proximate a rear portion thereof, and a disengaged position, enabling removal of said armrest frame from said wheelchair frame, said latch assembly further including a pivot assembly pivotally mounting said armrest frame to said wheelchair frame for pivotal movement between a closed position, urging said latch member to move toward said engaged position, and an opened position, pivoting said front post away from said wheelchair frame and releasing said latch member from said engaged position.

2. The armrest apparatus as defined in claim 1 further including:

a front locking mechanism operably coupling said front post to the wheelchair frame proximate a front portion thereof, said locking mechanism manually movable between a locked position, releasably locking said front post to said wheelchair frame when said pivot assembly is in said closed position, and an unlocked position, releasing said front post from said wheelchair frame.

3. The armrest apparatus as defined in claim 1 wherein, said latch member is formed for abutting contact against said wheelchair frame to urge said latch member toward said engaged position upon pivotal movement of said pivot assembly toward said closed position.

4. The armrest apparatus as defined in claim 3 wherein, said latch member includes a retaining pin moved into latching engagement with said rear post in said engaged position.

5. The armrest apparatus as defined in claim 4 wherein, said latch member further including a spring member operably urging said retaining pin toward said latching engagement with said rear post upon said abutting contact with said wheelchair frame in the closed position, and operably urging said retaining pin out of latching engagement with said wheelchair frame upon release of said abutting contact therewith in said opened position.

6. The armrest apparatus as defined in claim 5 wherein, said rear post includes an aperture formed and dimensioned for receipt of said retaining pin therethrough for said latching engagement therebetween in the engaged position.

7. The armrest apparatus as defined in claim 6 wherein, said latch member including a button portion contacting said wheelchair frame in the closed position of the pivot assembly to compress said spring member and urge said retaining pin through the rear post aperture.

8. The armrest apparatus as defined in claim 1 wherein, said pivot assembly includes a tube member pivotally mounted to said wheelchair frame, housing said latch member, and formed and dimensioned for sliding telescopic engagement with said rear post.

9. The armrest apparatus as defined in claim 8 wherein, said rear post defines a longitudinal bore at a distal end thereof form for sliding telescopic receipt of a distal end of said tube member therein.

10. An armrest apparatus for use with a wheelchair having a wheelchair frame, said armrest apparatus comprising:

an armrest frame having a front post and downwardly depending rear post;

a latch assembly operably mounting said armrest frame to a wheelchair frame, including a retaining pin movable between an engaged position, coupling said rear post to the wheelchair frame proximate a rear portion thereof, and a disengaged position, enabling removal of said rear post from said wheelchair frame, and a tube member operably housing said retaining pin therein, and formed and dimensioned for sliding telescopic engagement with said rear post, said tube member pivotally mounting said armrest frame to said wheelchair frame for pivotal movement between a closed position, enabling said retaining pin to move toward said engaged position, and an opened position, pivoting said front post away from said wheelchair frame and releasing said retaining pin from said engaged position; and a locking mechanism operably coupling said front post to the wheelchair frame proximate a front portion thereof, said locking mechanism manually movable between a locked position, releasably locking said front post to said wheelchair frame when said tube member is in said closed position, and an unlocked position, releasing said front post from said wheelchair frame.

11. The armrest apparatus as defined in claim 10 further including:

a spring member operably urging said retaining pin toward latching engagement with said rear post upon abutting contact thereof with said wheelchair frame in the closed position, and said spring member operably urging said retaining pin out of latching engagement with said wheelchair frame upon release of said abutting contact therewith in said opened position.

12. The armrest apparatus as defined in claim 11 wherein, said rear post includes an aperture formed and dimensioned for receipt of said retaining pin therethrough for said latching engagement therebetween in the engaged position.

13. A rear latching device for an armrest apparatus for use with a support frame, said armrest apparatus including an armrest frame having a front post and downwardly depending rear post, said latching device comprising:

a latch member movable between an engaged position, coupling said rear post to the support frame proximate a rear portion thereof, and a disengaged position, enabling removal of said armrest frame from the support frame; and a pivot assembly for pivotally mounting said armrest frame to the support frame for pivotal movement between a closed position, urging said latch member to move toward said engaged position, and an opened position, pivoting said front post away from the support frame and releasing said latch member from said engaged position.

14. The rear latching device as defined in claim 13 further including:

a front locking mechanism for operably coupling said front post to the support frame proximate a front portion thereof, said locking mechanism manually movable between a locked position, releasably locking said front post to said support frame when said pivot assembly is in said closed position, and an unlocked position, releasing said front post from said support frame.

15. The rear latching device as defined in claim 14 wherein, said latch member is formed for abutting contact against said support frame to urge said latch member toward said engaged position upon pivotal movement of said pivot assembly toward said closed position.

16. The rear latching device as defined in claim 15 wherein, said latch member includes a retaining pin moved into latching engagement with said rear post in said engaged position.

* * * * *